US005225738A

United States Patent [19]

Ramaiah et al.

[11] Patent Number: 5,225,738

[45] Date of Patent: Jul. 6, 1993

[54] METAL HALIDE LAMP WITH IMPROVED LUMEN OUTPUT AND COLOR RENDITION

[75] Inventors: Raghu Ramaiah, Painted Post; Daniel H. Brownell, Hornell, both of N.Y.

[73] Assignee: North American Philips Corporation, New York, N.Y.

[21] Appl. No.: 830,785

[22] Filed: Feb. 4, 1992

Related U.S. Application Data

[63] Continuation of Ser. No. 628,263, Dec. 14, 1990, abandoned.

[51] Int. Cl.[5] ..... H01J 61/22

[52] U.S. Cl. ..... 313/641; 313/25; 313/571; 313/634

[58] Field of Search ..... 313/639, 641, 642, 571, 313/25, 634

[56] References Cited

U.S. PATENT DOCUMENTS

| | | | |
|---|---|---|---|
| 3,234,421 | 2/1966 | Reiling | 313/25 |
| 3,407,327 | 10/1968 | Koury et al. | 313/572 X |
| 3,753,018 | 8/1973 | Beijer et al. | 313/25 |
| 3,911,308 | 10/1975 | Akutsu et al. | 313/25 X |
| 3,979,624 | 9/1976 | Liu et al. | 313/639 X |
| 4,232,243 | 11/1980 | Rigden | 313/634 X |
| 4,247,798 | 1/1981 | Howe et al. | 313/642 X |
| 4,709,184 | 11/1987 | Keefe et al. | 313/639 X |
| 4,866,342 | 9/1989 | Ramaiah et al. | 313/639 |
| 4,963,790 | 10/1990 | White et al. | 313/25 |

FOREIGN PATENT DOCUMENTS

| | | |
|---|---|---|
| 2362932 | 8/1975 | Fed. Rep. of Germany . |
| 55-80257 | 6/1980 | Japan . |
| 8300027 | 8/1983 | Netherlands . |

*Primary Examiner*—Donald J. Yusko
*Assistant Examiner*—Ashok Patel
*Attorney, Agent, or Firm*—Brian J. Wieghaus

[57] ABSTRACT

The luminous efficacy and color rendering index of a metal halide lamp containing sodium iodide and scandium iodide is increased, and the color correlated temperature is decreased, by the addition of critical amounts of thallium iodide and lithium iodide.

12 Claims, 5 Drawing Sheets

METAL HALIDE LAMP WITH IMPROVED LUMEN OUTPUT AND COLOR RENDITION

This is a continuation of application Ser. No. 07/628,263, filed Dec. 14, 1990 now abandoned.

BACKGROUND OF THE INVENTION

1. Field of the Invention

The invention relates to metal halide lamps, and more specifically, to improving the color rendition and luminous output of sodium-scandium metal halide lamps.

2. Description of the Prior Art

Metal halide lamps have been known and manufactured for approximately 30 years and typically include an inner quartz arc tube containing a fill of arc-sustaining material and surrounded by an outer glass envelope. The fill of the arc tube includes a rare gas for starting and a quantity of mercury. The lamp's emission spectrum is primarily due to the presence in the arc tube fill of one or more metal halides, usually iodides. The luminous efficacy, color rendering index, and other lamp output characteristics may be varied by the selection of the particular composition of the metal halides in the arc tube fill. For example, U.S. Pat. No. 3,234,421 to Reiling generally discloses metal halide lamps including iodides selected from those of Li, Na, Cs, Ca, Cd, Ba, Hg, Ga, In, Tl, Ge, Sn, Th, Se, Te and Zn.

In the United States, lamps based on a metal halide fill of predominantly sodium and scandium have been commercially successful due to their very good luminous efficacy and long operating life. Recently, low-wattage metal halide lamps (generally 100 watts or less) have found wider application as a replacement for incandescent lamps for general interior lighting and display lighting. In these applications, it is desirable to have good color rendering as well as high efficacy. An efficacy of greater than about 75 LPW and a color rendering $R_a$ greater than about 65 would be particularly advantageous for indoor low-wattage use. Additionally, it is desirable that the color temperature of such a metal halide lamp be as close to an incandescent lamp (CCT≅2850) as is practicable while maintaining the efficacy and CRI above 75 LPW and 65, respectively. However, metal halide lamps with the desired characteristics are not available in the prior art.

U.S. Pat. No. 3,979,624 to Liu et al teaches that enhanced efficacy in a lamp containing sodium and/or lithium iodides, as well as scandium iodide, requires a low alkali metal to scandium ratio of below 5:1. This is in contrast to the lamps of U.S. Pat. No. 3,407,327 to Corey et al which shows an $NaI:ScI_3$ molar ratio in excess of 11.5.

U.S. Pat. No. 4,247,798 to Howe et al shows a conventional tubular quartz arc tube metal halide lamp having lithium iodide to increase the proportion of red radiation and enhance color-rendering in a sodium-scandium lamp. In Howe, the molar proportion of lithium iodide is in the range of 10 to 50 percent of the total of sodium, lithium, and scandium iodides and the total molar ratio of alkali metal iodides to scandium iodide is between 5.4:1 and 57.1:1. Howe discloses lamps having efficacies of 66–76 lumens per watt (LPW) with corresponding color rendering indices $R_a$ of 84–74. Howe's data shows that the addition of any quantity of lithium iodide reduces the luminous efficacy. The Howe lamp achieved improved color rendition only at the expense of reductions in luminous efficacy as compared to a sodium scandium lamp without lithium iodide. Moreover, the Howe lamps had relatively high correlated color temperatures (CCT) of 3900°–4500° K. High color temperatures, for example, above about 4000° K. are undesirable for many applications because they provide a bluer or "colder" color than incandescent lamps, which are considered "warm".

U.S. Pat. No. 4,866,342 to Ramaiah et al discloses a tubular arc tube sodium-scandium lamp which includes thallium halide in a mole ratio of sodium halide to thallium halide of between 280:1 to 75:1 to increase the luminous efficacy of the lamp. With small amounts of thallium iodide, corresponding to the preferred NaI/TlI range of 260:1 to 240:1, both the color rendering and the efficacy are improved. With larger amounts of TlI the efficacy continues to increase but only at the expense of reductions in the color rendering. With small quantities of thallium corresponding to NaI/TlI ratios above 280:1 there is insufficient thallium to cause any appreciable increase in luminous efficacy. Ramaiah discloses lamps having relatively high luminous efficacies of between 85.4 and 97.3 LPW but with relatively low color rendering indexes $R_a$ of between about 62 and 55. The high luminous efficacies were only achieved with high CCT's of between 3850° and 4500° K.

Because of its wide commercial acceptance, it would be desirable to further improve upon the sodium-scandium metal halide lamp, and particularly for low-wattage applications.

Accordingly, it is an object of the invention to improve the color rendition of a sodium-scandium metal halide lamp while increasing its efficacy.

Another object of the invention is to provide such a lamp which also has a CCT below that of the prior art lamps.

Yet another object of the invention is to provide a sodium-scandium metal halide lamp having a luminous efficacy of greater than about 75 LPW and a color rendering index $R_a$ of greater than about 65.

Still another object of the invention is to provide such a lamp which also has a correlated color temperature below about 3500°.

SUMMARY OF THE INVENTION

According to the invention, a metal halide lamp comprises a sealed inner arc tube with discharge electrodes arranged therein between which a discharge is maintained during lamp operation, and a discharge sustaining fill within the arc tube consisting essentially of a rare gas, mercury, and the halides of sodium and scandium. The fill additionally contains lithium iodide and thallium iodide in the mole ratio of lithium iodide to thallium iodide of about 2:1 to about 25:1. The lamp has a luminous efficacy of above about 75 LPW and a CRI above about 65.

It was a surprise to find that with these ratios of lithium iodide to thallium iodide the luminous efficacy of a sodium-scandium lamp could be increased while simultaneously improving the color rendering index of the lamp.

According to another embodiment, a color rendering index above about 70 and luminous efficacy of greater than about 80 was achieved in a metal halide lamp with mole ratios of lithium iodide to thallium iodide of between about 4 and 10.

According to another embodiment, a correlated color temperature of below 3500° was obtained in a metal halide lamp having a color rendering above about 65 and a luminous efficacy above about 75 LPW.

The lamp according to the preferred embodiment is a low-wattage metal halide lamp having an arc tube defining a substantially elliptical discharge space.

Other features of the invention will be apparent from the drawings and detailed description which follow.

DESCRIPTION OF THE PREFERRED EMBODIMENT

Figure 1:
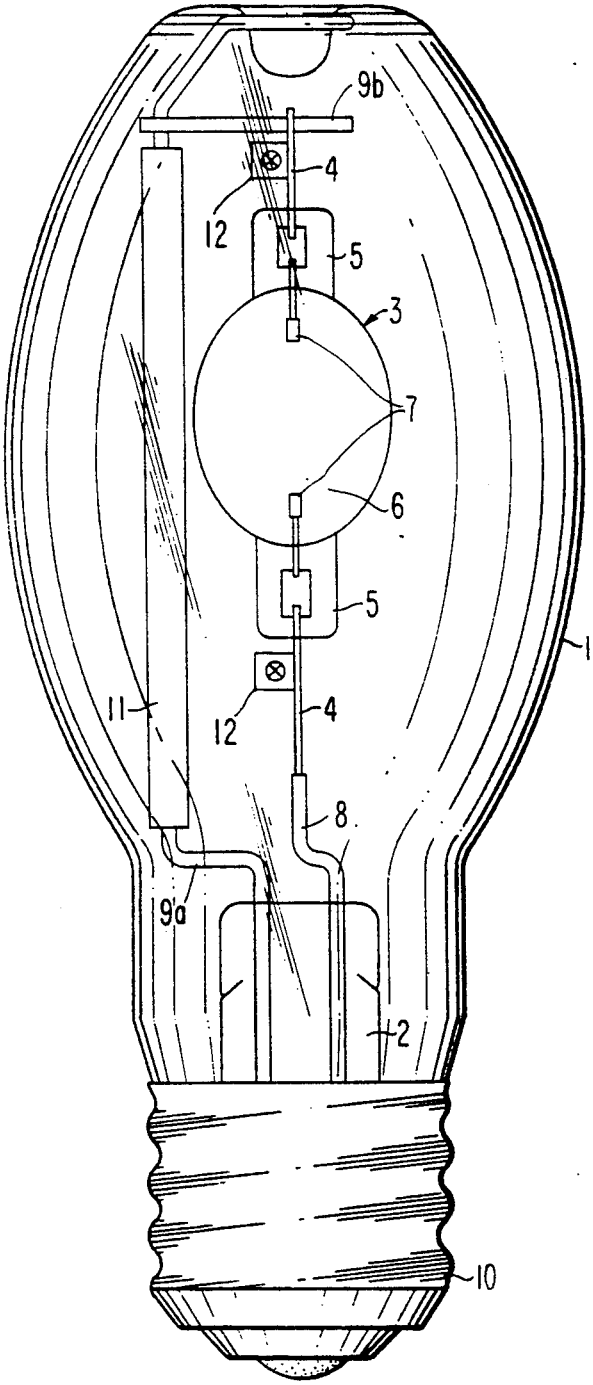
FIG. 1 is a front elevation view of a low wattage metal halide lamp according to the invention.

FIG. 1 shows a high-pressure 70 watt metal halide lamp having a transparent outer glass envelope 1 in which a quartz formed-body arc tube 3 is arranged. A lamp stem 2 seals the outer envelope 1 in a gas tight manner and a lamp cap 10 is provided at the sealed end of the envelope. Current-supply conductors 8 and 9*a*, 9*b* are connected to respective terminals on the lamp cap, extend through the lamp stem and are connected to respective feed-throughs 4 extending through pinch seals 5 of the arc tube 3. The arc tube defines a substantially elliptical discharge space 6 in which a discharge is maintained during lamp operation between discharge electrodes 7, which are arranged in the discharge space 6 and connected to feed-throughs 4. A quartz sleeve 11 covers the portion of conductor 9 which extends past the arc tube 3 and conventional getters 12 are supported on the feed-throughs 4.

A quantity of mercury and a smaller quantity of an inert ionizable starting gas, such as argon, are contained within the arc tube. In accordance with the invention there is also present within the arc tube small additive quantities of thallium halide, either iodides or bromides or a mixture of the two, and lithium iodides. Such addition has found to be effective in increasing the luminous efficacy of the lamp while increasing the color rendering index and beneficially lowering the correlated color temperature. For this purpose, the thallium halide and lithium iodide are present in a mole ratio of about 2.2:1 to about 25:1. According to an embodiment of the invention, the mole ratio of lithium iodide to thallium iodide is maintained within the range from about 4:1 to about 10:1.

EXAMPLES

Eight groups of test lamps, designated A–H, of 70 watt metal halide lamps were prepared containing a fill of about 4 mg of NaI/$ScI_3$ salt, 13 mg of mercury and 100 torr of argon. The volume of the arc tube was 0.45 cc and the arc length was 8.0 mm. Each group contained 3 lamps. A three factor designed experiment was conducted in which the only parameters varied were the NaI/$ScI_3$ mole ratio and the weights of LiI and TlI. The lamps had the NaI/$ScI_3$ mole ratios and doses of TlI and LiI shown in Table I.

TABLE I

| GROUP # | SALTS DOSE NaI/$ScI_3$ | TlI | LiI |
|---|---|---|---|
| 1 A | 11.36:1 | 0.1 mg | 0.5 mg |
| 2 B | 30.2:1 | 0.1 mg | 0.5 mg |
| 3 C | 11.36:1 | 0.56 mg | 0.5 mg |
| 4 D | 30.2:1 | 0.56 mg | 0.5 mg |
| 5 E | 11.36:1 | 0.1 mg | 1.0 mg |
| 6 F | 30.2:1 | 0.1 mg | 1.0 mg |
| 7 G | 11.36:1 | 0.56 mg | 1.0 mg |
| 8 H | 30.2:1 | 0.56 mg | 1.0 mg |

As evident from Table I, the groups differed by the particular combination of the NaI/$ScI_3$ mole ratio of either 11.4:1 of 30.2:1, the weight of LiI of 0.1 mg or 1.0 mg, and the weight of TlI of 0.1 mg or 0.56 mg. The range of mole ratios of NaI/LiI, NaI/TlI and LiI/TlI covered by the above groups are shown in Tables II, III and IV, respectively.

TABLE II

| | NaI | NaI |
|---|---|---|
| LiI | 0.0214 | 0.0244 |
| 0.00373 | 5.74 | 6.54 |
| 0.00746 | 2.87 | 3.27 |

TABLE III

| | NaI | NaI |
|---|---|---|
| TlI | 0.0214 | 0.0244 |
| 0.00030 | 71.74 | 81.3 |
| 0.00169 | 12.7 | 14.4 |

TABLE IV

| | LiI | LiI |
|---|---|---|
| TlI | 0.00373 | 0.00746 |
| 0.00030 | 12.4 | 24.9 |
| 0.00169 | 2.2 | 4.4 |

The test lamps were operated for a period of 100 hours, and were then evaluated by measuring the luminous efficacy as indicated by the output in lumen per watt (LPW), the color rendering index $R_a$, and the correlated color temperature (CCT). These were compared to a control group of 11 lamps having a conventional fill of NaI/$ScI_3$ in a mole ratio of 30.2:1, which exhibited after 100 hours an efficacy of 74 LPW, $R_a$ of 56, and CCT of 3114° K. The lamp efficacy and color rendering of the control group was significantly below the desired LPW of 75 and CRI of 65.

Figure 2:
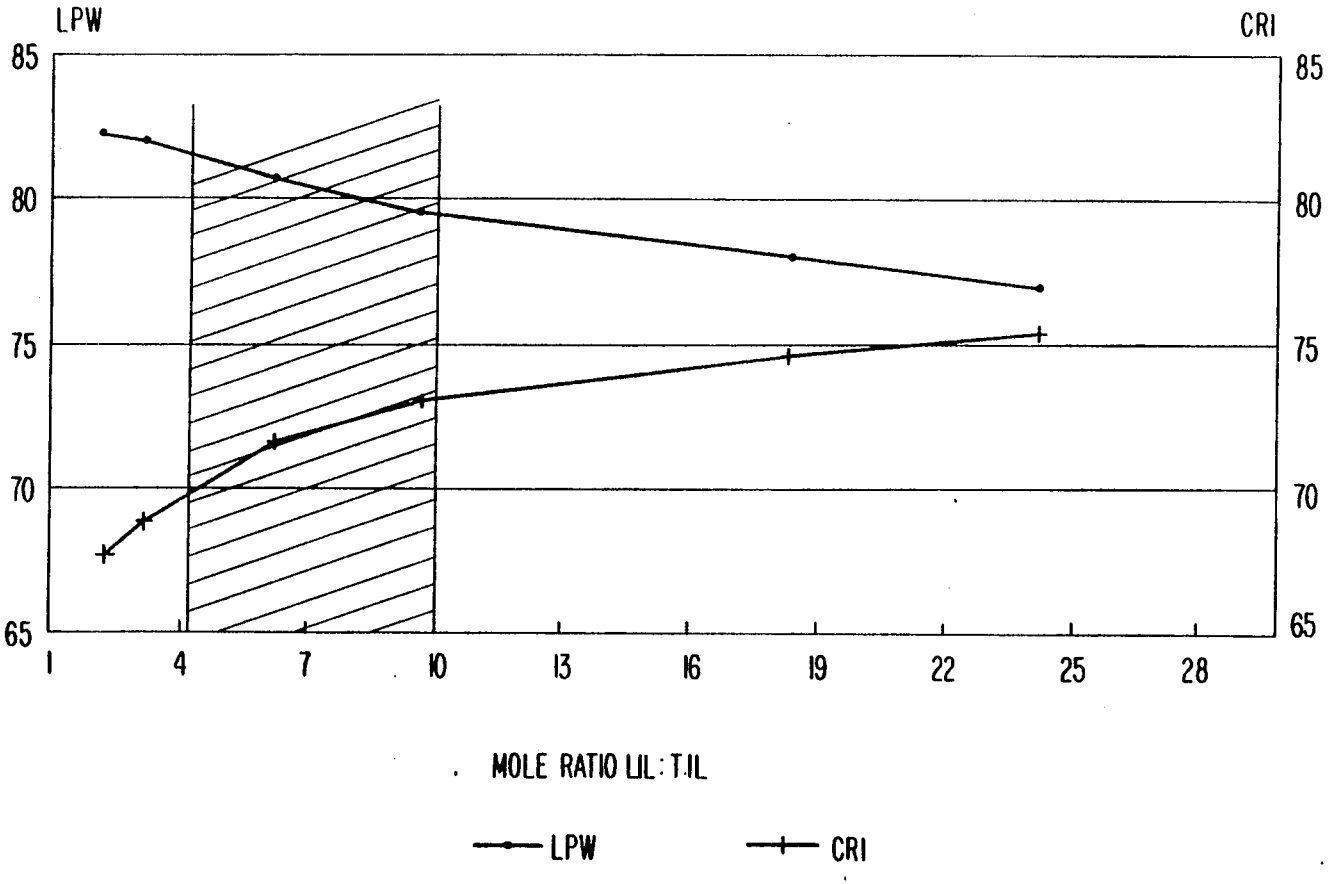
FIG. 2 is a graph of lamp efficacy and color rendering index as a function of the LiI/TlI mole ratio for a 12:1 mole ratio of NaI:$ScI_3$.
Figure 3:
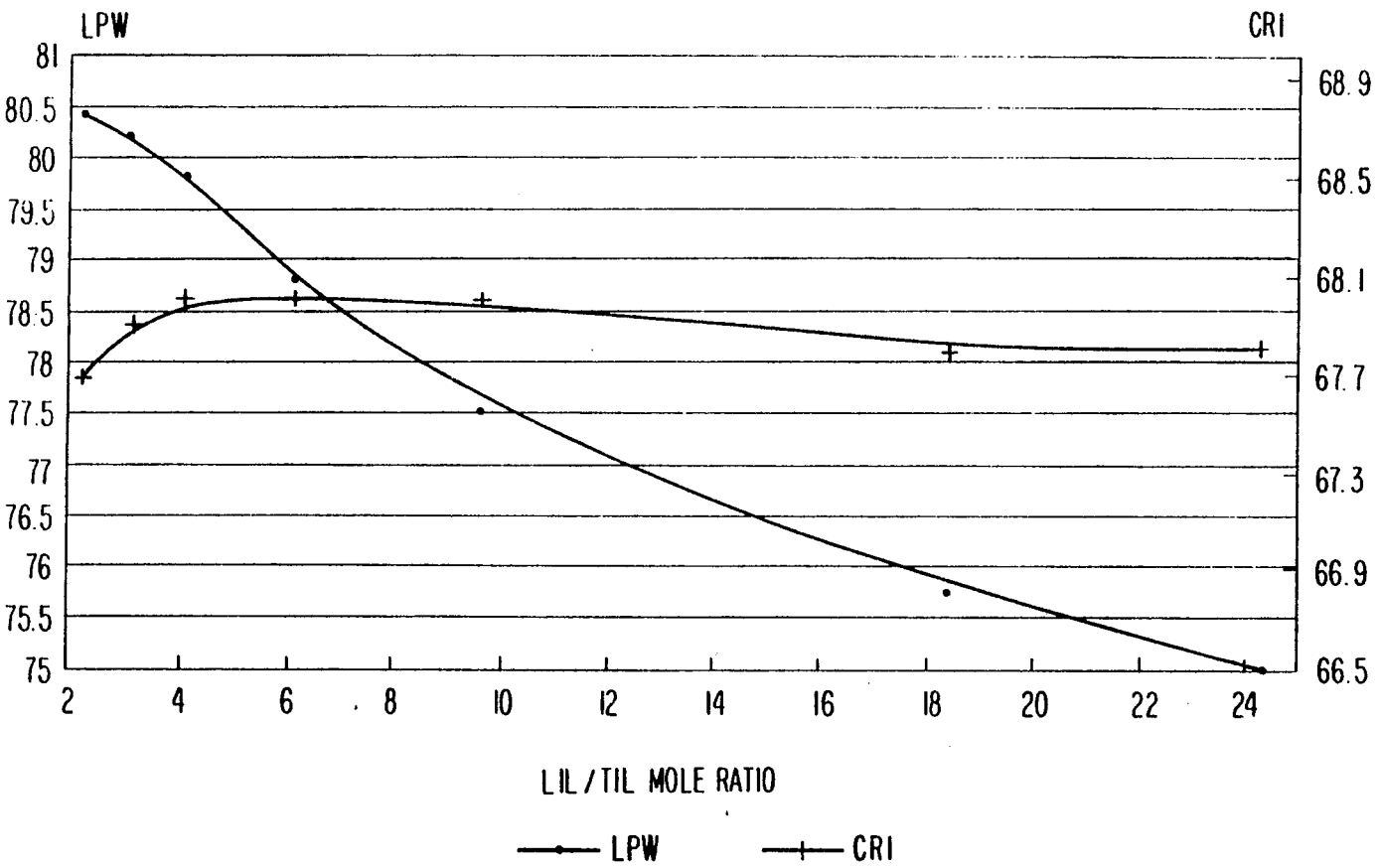
FIG. 3 is a graph of lamp efficacy and color rendering index as a function of the LiI/TlI mole ratio for a 30.2:1 mole ratio of NaI:$ScI_3$.

FIGS. 2 and 3 show the lamp efficacy (LPW) and color rendering index $R_a$ as a function of the mole ratio of LiI to TlI for constant NaI/$ScI_3$ mole ratios of 12:1 and 30.2:1. As shown in these figures, the luminous efficacy decreases with increasing LiI/TlI ratios while the color rendering generally increases. With mole ratios between about 2 and about 25, the color rendering index and luminous efficacy (LPW) were respectively above 67 and above about 74.5 for NaI/$ScI_3$ mole ratios of either of about 12:1 or of about 30.2:1. As shown in FIG. 2, a region exists in which in which the CRI and LPW are both above about 75 for the ratio of LiI:TlI of greater than about 22. Thus, as shown in Table V these lamps exhibit a better color rendering $R_a$ than achieved by Ramaiah and a better luminous efficacy than achieved by Howe.

TABLE V

| | Howe '798 | Ramaiah '342 | Example $NaI/ScI_3$ = 12:1 | Example $NaI/ScI_3$ = 30.2:1 |
|---|---|---|---|---|
| LPW | 66–76 | 85–97 | 82–77 | 80.5–75 |
| CRI | 84–74 | 62–52 | 75.5–67 | 68–67.7 |
| CCT (°K.) | 3900–4500 | 3850–4500 | 3600–4125 | 3225–3700 |

While the mole ratios of NaI/LiI for the groups 1–8 of between 2.8 and 6.5 compares to the mole ratios of 2 to 8 disclosed in the Howe patent, the mole ratio of NaI/TlI of between about 12 and 81 is substantially outside the range of 280 to 75 of Ramaiah '342 and substantially lower than the preferred range of 260 to 240 disclosed in that patent. NaI/TlI ratios of below 75 represent an increased proportion of thallium iodide for which Ramaiah '342 shows that the color rendering is adversely affected as compared to a lamp without thallium iodide. Since Howe teaches that the luminous efficacy is adversely affected by LiI, it was surprising and unexpected to find that by controlling the ratios of LiI/TlI, both increased color rendering and increased luminous efficacy could be achieved as compared to a sodium-scandium lamp without lithium iodide or thallium iodide.

The improvement in both color rendering and efficacy is believed to be the result of the following. Luminous efficacy is increased by increasing radiation near the maximum of the eye sensitivity curve (550 nm). If Li is added to improve color rendering by increasing emission in red radiation, its radiation takes away from the luminous efficacy of the system because it emits strongly at 610 nm and 671 nm. According to the invention, it was discovered that by maintaining the LiI/TlI mole ratio between about 2 and 25, what luminous efficacy is lost by LiI is not only regained but is increased by the critical amounts of TlI.

According to another embodiment, a metal halide lamp has mole ratios of lithium iodide to thallium iodide maintained between about 4 and 10. Such a lamp has a luminous efficacy of greater than about 79.5 lumens per watt with a color rendering index $R_a$ above 70, as shown in FIG. 2, for a sodium/scandium mole ratio of 12:1 and a LiI/NaI ratio of between about 4 and 10. For a sodium/scandium mole ratio of about 30:1, FIG. 3 shows that a fairly constant CRI of about 68 is achieved.

Figure 4:
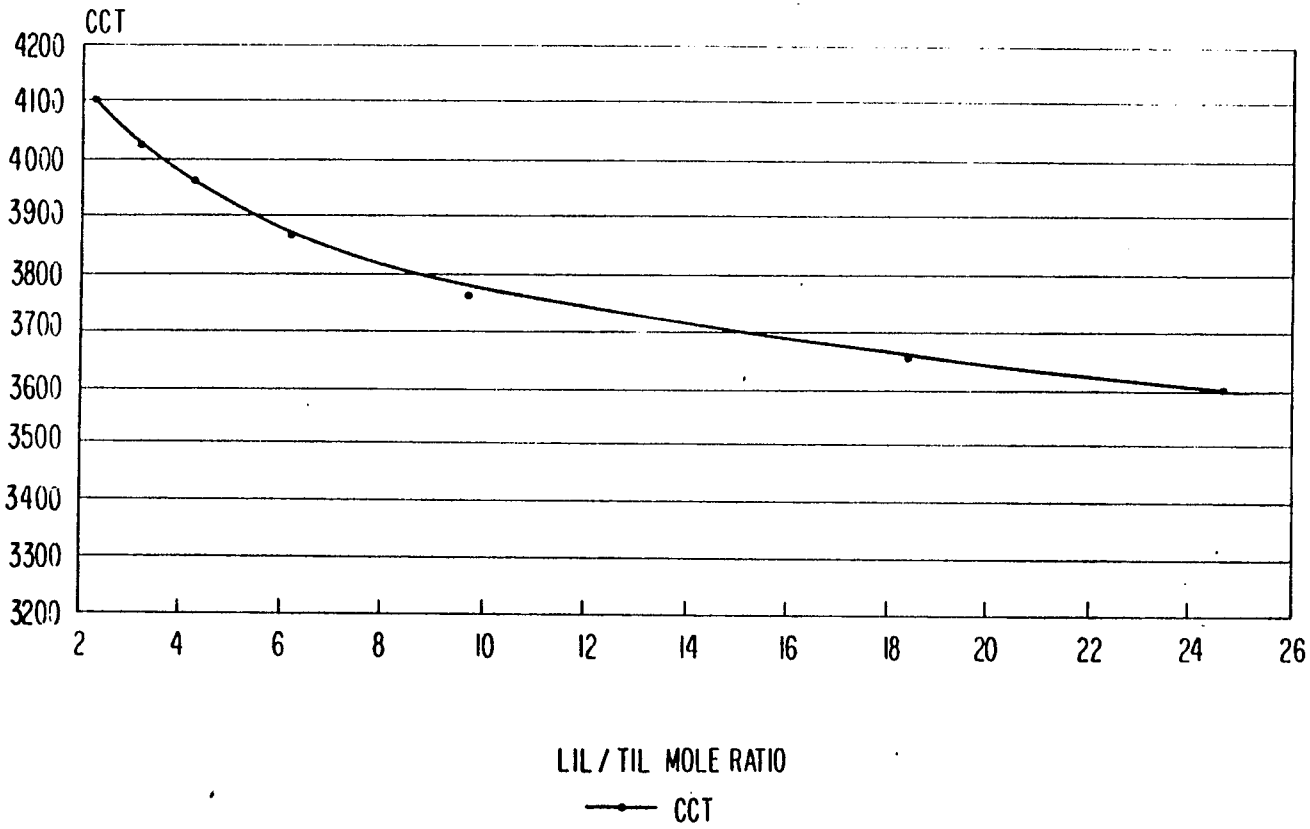
FIG. 4 is a graph of correlated color temperature as a function of the LiI/TlI mole ratio for a 12:1 mole ratio of NaI:$ScI_3$.
Figure 5:
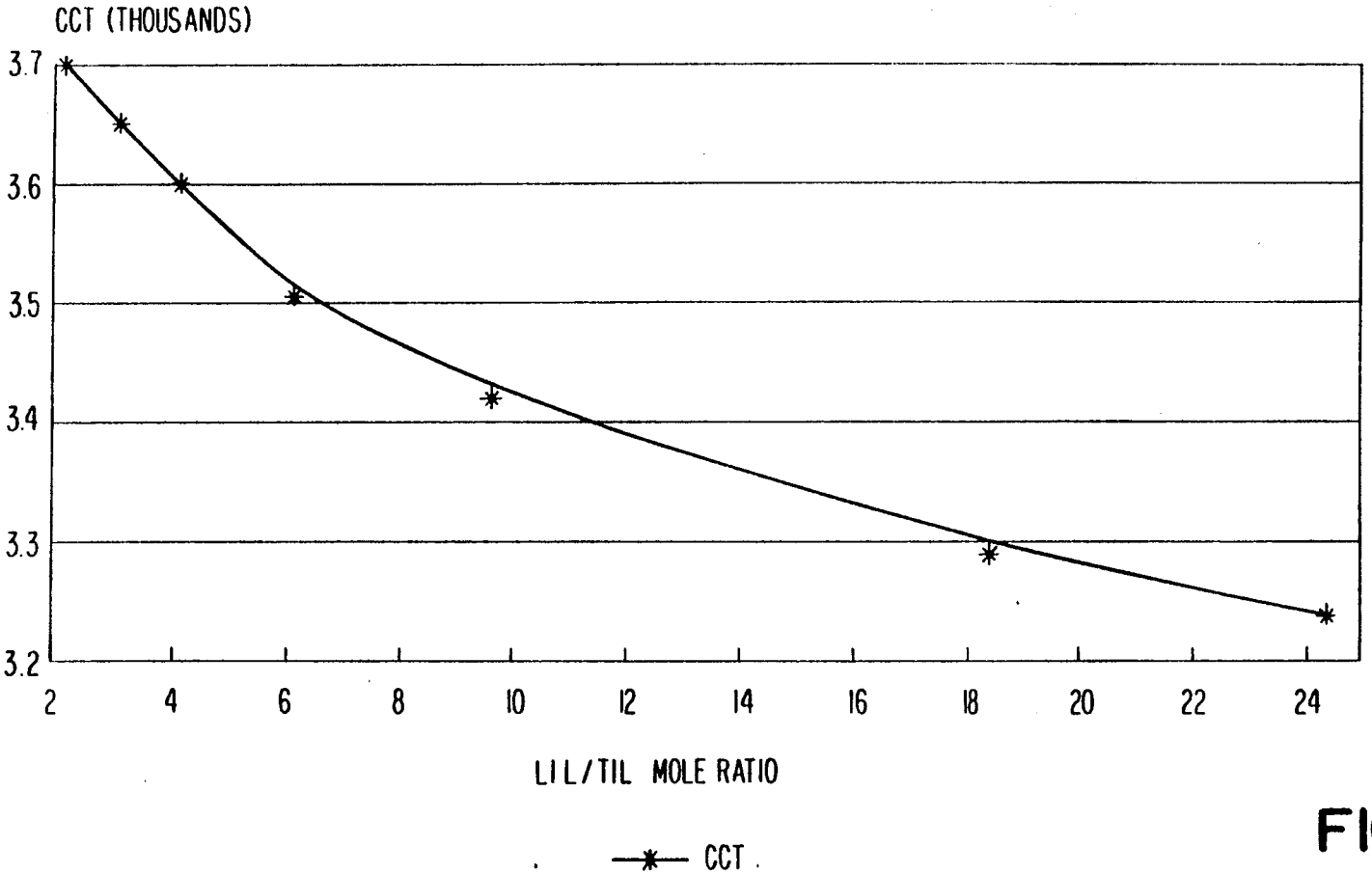
FIG. 5 is a graph of correlated color temperature as a function of the LiI/TlI mole ratio for a 30.2:1 mole ratio of NaI:$ScI_3$.

Additionally, FIG. 4 shows the dependence of correlated color temperature on the mole ratio of LiI/TlI for an $NaI/ScI_3$ mole ratio of 12:1. For LiI/TlI mole ratios of greater than about 4, a CCT of below 4000° K. can be obtained for LiI/TlI ratios of greater than about 6, a CCT of below 3850° K. is achieved. The latter is below that of both the Ramaiah and Howe lamps while maintaining the CRI above Ramaiah's lamps and the LPW above Howe's. (Table V)

For $NaI/ScI_3$ ratios of 30.2:1, FIG. 3 shows that both the lamp efficacy and color rendering are slightly lower than for $NaI/ScI_3$ ratios of 12:1 for corresponding ratios of LiI/TlI. However, this small decrease is accompanied by a favorably large decrease of about 350° in the correlated color temperatures for corresponding LiI/TlI ratios. Thus, while still maintaining the lamp efficacy and color rendering above the prior art, a metal halide lamp can be obtained which much more closely matches the color appearance of an incandescent lamp than the prior art lamps. An additional advantage of higher $NaI/ScI_3$ ratios is reduced end blackening of the arc tube and improved maintenance as compared to lower ratios of $NaI/ScI_3$, for example 12:1.

According to a favorable embodiment of a lamp having a $NaI/ScI_3$ ratio of about 30.2:1, the mole ratio of sodium iodide to lithium iodide is about 2.8:1 to about 6.5:1. In another favorable embodiment, the thallium halide is thallium iodide and is present in a mole ratio of sodium iodide to thallium iodide of between about 12:1 and about 81:1. In yet another embodiment, the mole ratio of sodium iodide to thallium iodide is about 81:1 and the mole ratio of lithium iodide to thallium iodide is about 12:1. In still another embodiment, a mole ratio of lithium iodide to thallium iodide of between about 4:1 and 10:1 yielded a color rendering index of about 68 as shown in FIG. 3.

According to the preferred embodiment, the arc tube had the following mole distribution of fill components. $NaI:ScI_3=30.2:1$; $NaI:TlI=80.8:1$; $NaI:LiI=6.53:1$; and $LiI:TlI=12.4:1$. A group of twelve lamps of this fill achieved an average luminous efficacy of 78 lumens per watt, an average CRI of 69 and an average correlated color temperature (CCT) of 3300° K. This color temperature is attractively similar in warmth to an incandescent lamp and significantly better than the color temperatures obtained in the Howe and Ramaiah patents.

We claim:

1. In a metal halide lamp comprising an arc tube sealed in a gas-tight manner, electrodes arranged within the arc tube between which a discharge is maintained during lamp operation, and means for energizing the arc tube to emit light, said arc tube having a discharge sustaining fill comprising a rare gas, mercury, and halides of sodium and scandium, the improvement comprising:

said halides of sodium and scandium being present as iodides of sodium and scandium in a mole ratio of sodium iodiode to scandium iodiode about 12:1;

said fill additionally containing thallium iodide and lithium iodide in a mole ratio of lithium iodide to thallium iodide of greater than about 21:1; and said lamp having a luminous efficacy greater than about 77 lumens per watt and a color rendering index $R_a$ greater than about 75.

2. In a metal halide lamp according to claim 1, wherein said lamp has a color correlated temperature CCT of below about 3635° K.

3. In a low-wattage metal halide lamp comprising an arc tube sealed in a gas-tight manner, said arc tube having discharge electrodes arranged within said discharge space between which a discharge is maintained during lamp operation, and a discharge sustaining fill within the arc tube consisting essentially of a rare gas, mercury, and halides of sodium and scandium, and means for energizing said arc tube to emit light, wherein the improvement comprises:

said halides of sodium and scandium being present in said fill as iodides of sodium and scandium in a mole ratio of sodium iodide to scandium iodide of about 30.2:1;

said fill additionally contains thallium iodide and lithium iodide in a mole ratio of lithium iodide to thallium iodide of about 2.2:1 to about 25:1;

and said lamp has a luminous efficacy greater than about 75 and a color rendering index of greater than about 67.7.

4. In a low-wattage metal halide lamp according to claim 3, wherein said sodium iodide and lithium iodide are present in said fill in a mole ratio of sodium iodide to lithium iodide of about 2.8:1 to about 6.5:1.

5. In a low wattage metal halide lamp according to claim 4, wherein said arc tube defines an elliptical discharge space.

6. In a low-wattage metal halide lamp according to claim 4, wherein said sodium iodide and thallium iodide are present in a mole ratio of sodium iodide to thallium iodide of between about 12:1 to about 81:1.

7. In a low wattage metal halide lamp according to claim 6, wherein said arc tube defines an elliptical discharge space.

8. In a metal halide lamp according to claim 6, wherein said iodides of sodium, thallium and lithium are present in said fill in a mole ratio of sodium iodide to thallium iodide of about 81:1, and a mole ratio of lithium iodide to thallium iodide of about 12:1.

9. In a low wattage metal halide lamp according to claim 8, wherein said arc tube defines an elliptical discharge space.

10. In a low-wattage metal halide lamp according to claim 3, wherein said iodides of lithium and thallium are present in said fill in a mole ratio of lithium iodide to thallium iodide of between about 4:1 and 10:1.

11. In a low wattage metal halide lamp according to claim 10, wherein said arc tube defines an elliptical discharge space.

12. In a low wattage metal halide lamp according to claim 3, wherein said arc tube defines an elliptical discharge space.

* * * * *